US008471499B2

(12) United States Patent
Um et al.

(10) Patent No.: US 8,471,499 B2
(45) Date of Patent: Jun. 25, 2013

(54) LIGHT SOURCE DRIVER

(75) Inventors: Jae Eun Um, Cheonan-si (KR); Ja Min Koo, Yongin-si (KR); Jae Kyu Park, Asan-si (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 158 days.

(21) Appl. No.: 13/213,267

(22) Filed: Aug. 19, 2011

(65) Prior Publication Data

US 2012/0256554 A1 Oct. 11, 2012

(30) Foreign Application Priority Data

Apr. 7, 2011 (KR) ..... 10-2011-0032212

(51) Int. Cl.
*H05B 37/02* (2006.01)

(52) U.S. Cl.
USPC ..... 315/307; 315/193; 315/224

(58) Field of Classification Search
USPC ..... 315/291, 307, 308, 185 R, 193, 192, 315/224
See application file for complete search history.

(56) References Cited

U.S. PATENT DOCUMENTS

| | | | | |
|---|---|---|---|---|
| 4,879,626 | A | 11/1989 | Kim | |
| 7,741,788 | B2 * | 6/2010 | Ito et al. | 315/247 |
| 2010/0090618 | A1 * | 4/2010 | Veltman | 315/307 |

FOREIGN PATENT DOCUMENTS

| | | |
|---|---|---|
| JP | 11-088607 | 3/1999 |
| JP | 4299006 | 4/2009 |
| JP | 2009-261213 | 11/2009 |
| JP | 2010118194 | 5/2010 |
| KR | 1020030088764 | 11/2003 |
| KR | 1020070008106 | 1/2007 |
| KR | 1020080008021 | 1/2008 |
| KR | 1020080106035 | 12/2008 |
| KR | 1020080085272 | 9/2009 |
| KR | 100949392 | 3/2010 |

* cited by examiner

*Primary Examiner* — David H Vu
(74) *Attorney, Agent, or Firm* — F. Chau & Associates, LLC

(57) ABSTRACT

A light emitting diode (LED) driver is provided that includes a light emitting diode, a converter connected to the light emitting diode, wherein the converter receives an input voltage and converts the input voltage to a basic voltage for driving the light emitting diode, a current regulator connected to the light emitting diode, a first operational amplifier connected to the current regulator, an analog dimming voltage generating unit including a second operational amplifier, a first resistor, a second resistor, and a third resistor, wherein a first terminal of the first resistor, a first terminal of the second resistor, and a first terminal of the third resistor are connected to a non-inversion terminal of the second operational amplifier, and connected to the first operational amplifier, and a pulse-width-modulation dimming pulse generating unit connected to a second terminal of the third resistor.

20 Claims, 4 Drawing Sheets

LIGHT SOURCE DRIVER

CROSS-REFERENCE TO RELATED APPLICATION

This application claims priority to and the benefit of Korean Patent Application No. 10-2011-0032212 filed in the Korean Intellectual Property Office on Apr. 7, 2011, the entire contents of which are herein incorporated by reference.

BACKGROUND (a) Technical Field

The embodiments of the present invention are directed to a light source driver, and particularly to a light emitting diode (LED) driver.

(b) Discussion of the Related Art

A light emitting diode ("LED") is used as a light source for various display devices. A cold cathode fluorescent lamp ("CCFL") is driven by high-frequency AC current, and the LED is driven by DC current.

A DC/DC converter used for driving the LED includes a rectifier circuit unit for generating a DC current. An LED driving method for controlling luminance of an LED includes a pulse width modulation ("PWM") dimming control method and an analog dimming control method. The PWM dimming control method controls brightness of the LED by adjusting an on/off duration ratio of the LED depending on a PWM signal. For example, when a PWM signal provided to the LED has an on/off duration ratio of 4:1, the brightness of the LED reaches 80% of the maximum brightness. The analog dimming control method controls brightness of the LED by adjusting the current supplied to the LED.

An LED driver drives a bipolar junction transistor ("BJT") or a metal-oxide-semiconductor field-effect transistor ("MOSFET") in a linear region to control impedance between the collector and emitter and to keep the current flowing through the LED constant.

The BJT or the MOSFET is used as a current regulator for constantly maintaining the current flowing across a light source. The current regulator enables current to stop flowing through the LED when PWM dimming is turned off to prevent deterioration of characteristics of the light source, which may result in a voltage stress to the current regulator.

SUMMARY

An exemplary embodiment of the present invention provides a light emitting diode (LED) driver, including a light emitting diode, a converter connected to the light emitting diode, wherein the converter receives an input voltage and converts the input voltage to a basic voltage for driving the light emitting diode, a current regulator connected to the light emitting diode, a first operational amplifier connected to the current regulator, an analog dimming voltage generating unit including a second operational amplifier, a first resistor, a second resistor, and a third resistor, wherein a first terminal of the first resistor, a first terminal of the second resistor, and a first terminal of the third resistor are connected to a non-inversion terminal of the second operational amplifier, and connected to the first operational amplifier, and a pulse-width-modulation dimming pulse generating unit connected to a second terminal of the third resistor.

A second terminal of the first resistor may be connected to a reference voltage, and a second terminal of the second resistor may be grounded.

An inversion terminal of the second operational amplifier may be connected to an output terminal of the second operational amplifier.

The output terminal of the second operational amplifier may be connected to the non-inversion terminal of the first operational amplifier.

A fourth resistor may be connected between the output terminal of the second operational amplifier and the non-inversion terminal of the first operational amplifier.

The current regulator may include a bipolar junction transistor.

A base of the bipolar junction transistor may be connected to an output terminal of the first operational amplifier, an emitter of the bipolar junction transistor may be connected to the inversion terminal of the first operational amplifier, and a collector of the bipolar junction transistor may be connected to the light emitting diode.

The light emitting diode (LED) driver may further include a sensing resistor connected to the current regulator.

A first terminal of the sensing resistor may be connected to the inversion terminal of the first operational amplifier and the current regulator and a second terminal of the sensing resistor may be grounded.

An exemplary embodiment of the present invention provides a light emitting diode (LED) driver, including a light emitting diode, a converter connected to the light emitting diode, wherein the converter receives an input voltage and converts the input voltage to a basic voltage for driving the light emitting diode, a first current regulator connected to the light emitting diode, a first operational amplifier connected to the first current regulator, a second current regulator connected to the first current regulator and the first operational amplifier, an analog dimming voltage generating unit including a second operational amplifier, a first resistor, and a second resistor, wherein a first terminal of the first resistor and a first terminal of the second resistor are connected to a non-inversion terminal of the second operational amplifier, and connected to the first operational amplifier, and a pulse-width-modulation dimming pulse generating unit connected to the second current regulator.

The first current regulator may include a first bipolar junction transistor and a second current regulator may include a second bipolar junction transistor.

An emitter of the first bipolar junction transistor and a collector of the second bipolar junction transistor may be connected to an inversion terminal of the first operational amplifier.

A base of the second bipolar junction transistor may be connected to the pulse width modulation dimming pulse generating unit and an emitter of the second bipolar junction transistor may be grounded.

A third resistor may be connected between a collector of the second bipolar junction transistor and an inversion terminal of the first operational amplifier.

The light emitting diode (LED) driver may further include a sensing resistor connected to the first current regulator and the second current regulator.

A first terminal of the sensing resistor may be connected to an inversion terminal of the first operational amplifier, the first current regulator, and the second current regulator and a second terminal of the sensing resistor may be grounded.

An exemplary embodiment of the present invention provides a driver for a light source, including a voltage converter connected to the light source, a current regulator connected to the light source, an operational amplifier connected to the current regulator, an analog dimming voltage generating unit including a first terminal, a second terminal, and a third terminal, wherein the first terminal is connected to a reference voltage, and the second terminal is connected to a non-inversion terminal of the operation amplifier, and a pulse-width-modulation (PWM) dimming pulse generating unit connected to the third terminal of the analog dimming voltage generating unit, wherein the analog dimming voltage generating unit adjusts an analog dimming voltage so that a micro current flows through the light source when a PWM dimming pulse is turned off by the PWM dimming pulse generating unit.

According to the exemplary embodiments of the present invention, voltage stress in the current regulator of the LED driver can be reduced.

DETAILED DESCRIPTION OF THE EMBODIMENTS

Figure 1:
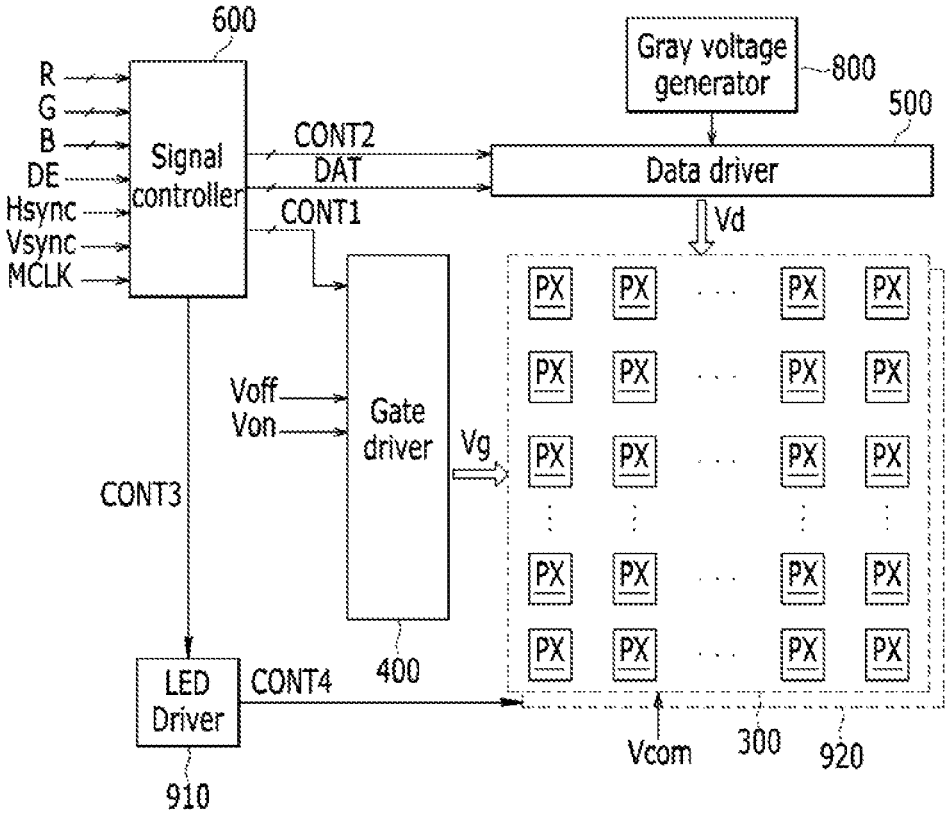
FIG. 1 is a schematic diagram illustrating a liquid crystal display according to an exemplary embodiment of the present invention.

The embodiments of the present invention are described more fully hereinafter with reference to the accompanying drawings, in which like reference numerals may designate like or similar elements throughout the specification and the drawings.

FIG. 1 is a schematic diagram illustrating a liquid crystal display according to an exemplary embodiment of the present invention.

Referring to FIG. 1, a liquid crystal panel assembly 300 includes a plurality of pixels PX arranged in an approximately matrix shape. The plurality of pixels PX are connected to a plurality of signal lines. The signal lines include a plurality of gate lines each transferring a gate signal (also, referred to as "a scanning signal") and a data line each transferring a data signal.

A backlight unit 920 is a light source of the liquid crystal display. The backlight unit 920 includes LEDs. According to an embodiment, the backlight unit 920 includes a direct type backlight unit or an edge type backlight unit.

An LED driver 910 controls an on/off time, brightness, and the like of the backlight unit 920 using a control signal CONT4.

A gray voltage generator 800 generates two gray voltage sets (or reference gray voltage sets) related to transmittance of pixels. One set of the two voltage sets has a positive value for a common voltage Vcom and the other set has a negative value for the common voltage Vcom.

A gate driver 400 is connected to gate lines of the liquid crystal panel assembly 300 to apply gate signals including gate-on voltages Von and gate-off voltages Voff to the gate lines.

A data driver 500 is connected to data lines of the liquid crystal panel assembly 300 to select gray voltages from the gray voltage generator 800 and apply the selected gray voltages as data signals to the pixels. However, when the gray voltage generator 800 provides only some of the gray voltages, the data driver 500 divides the reference gray voltages to generate the gray voltages for the entire grays and selects as the data signals some of the generated gray voltages.

A signal controller 600 controls the gate driver 400, the data driver 500, and the LED driver 910.

According to an embodiment, at least one of the elements 400, 500, 600, 800, and 910 is directly mounted on the liquid crystal panel assembly 300 in an IC chip form or is mounted on a flexible printed circuit film (not shown) to be attached to the liquid crystal panel assembly 300 in a tape carrier package (TCP) form. According to an embodiment, at least one of the elements 400, 500, 600, and 800 is also integrated to the liquid crystal panel assembly 300 together with signal lines, thin film transistor switching elements Q, or the like. According to an embodiment, all of the elements 400, 500, 600, and 800 are integrated in a single chip. According to an embodiment, at least one of the elements 400, 500, 600, and 800 or at least a circuit element constituting the elements 400, 500, 600, and 800 is disposed at an outside of the single chip.

The signal controller 600 receives input image signals R, G, and B and input control signals controlling display of the input image signals from an external graphic controller (not shown). The input image signals R, G and B include luminance information of each pixel PX, wherein the luminance has a defined number, for example, 1024 ($=2^{10}$), 256 ($=2^{8}$),) or 64 ($=2^{6}$) of grays. Examples of the input control signals are a vertical synchronization signal Vsync, a horizontal synchronizing signal Hsync, a main clock MCLK, a data enable signal DE, or the like.

The signal controller 600 appropriately processes the input image signals R, G, and B based on the input image signals R, G, and B and the input control signals to be suitable for operational conditions of the liquid crystal panel assembly 300 and the data driver 500. The signal controller 600 generates a gate control signal CONT1, a data control signal CONT2, a backlight control signal CONT3, and image signals DAT digitally processed, and then, transmits the gate control signal CONT1 to the gate driver 400, the data control signal CONT2 and image signals DAT to the data driver 500, and the backlight control signal CONT3 to the LED driver 910. The output image signal DAT has a defined number of values (or grays) as a digital signal.

The gate control signal CONT1 includes a scanning start signal STV indicating a scanning start and at least one clock signal controlling an output period of a gate-on voltage Von. According to an embodiment, the gate control signal CONT1 further includes an output enable signal OE defining duration of the gate-on voltage Von.

The data control signal CONT2 includes a horizontal synchronization start signal STH that indicates a transmission start of the image signal DAT for a pixel of a row, a load signal LOAD that applies the data signals to the data lines D1-Dm, and a data clock signal HCLK. According to an embodiment, the data control signal CONT2 further includes an inversion signal RVS that inverts a polarity of the data signal with respect to the common voltage Vcom (hereinafter, also referred to as "a polarity of the data signal").

According to the data control signal CONT2 from the signal controller 600, the data driver 500 receives digitally processed image signals DAT for a row of pixels PX and selects gray voltages corresponding to the respective image signals DAT, then converts the image signals DAT into analog data signals which are then applied to the corresponding data lines D1-Dm. The number of gray voltages generated by the gray voltage generator 800 is the same as the number of grays represented by the image signals DAT.

The gate driver 400 applies the gate-on voltages Von to gate lines G1-Gn according to the gate control signal CONT1 from the signal controller 600 to turn-on the switching elements Q connected to the gate lines G1-Gn. Then, the data signals applied to the data lines D1-Dm are applied to the corresponding pixels PX through the turned-on switching elements Q.

A difference between the voltage of the data signal applied to the pixel PX and the common voltage Vcom is represented as a voltage charged to a liquid crystal capacitor CLC, for example, a pixel voltage. An alignment of liquid crystal molecules varies depending on a magnitude of the pixel voltage such that polarization of light passing through a liquid crystal layer (not shown) is changed. The change in the polarization is represented as a change in transmittance of light by a polarizer (not shown) attached to the panel assembly 300 such that the pixel PX expresses the luminance represented by the gray of the image signal DAT.

The gate-on voltages Von are sequentially applied to the plurality of gate lines and the data signals are applied to the plurality of pixels PX to display an image of a frame by repeating the process every 1 horizontal period 1H (also referred to as "1H" that is the same as one period of the horizontal synchronizing signal Hsync and the data enable signal DE).

When one frame ends and next frame starts, a state of the inversion signal RVS applied to the data driver 500 is controlled so that a polarity of the data signal applied to each pixel PX is opposite to a polarity of the data signal during a previous frame ("frame inversion"). According to an embodiment, the polarity of the data signal flowing through one data line is changed (for example, row and dot inversion) or the polarities of the data signals applied to one pixel row are changed (for example, column and dot inversion) during a frame according to the characteristic of the inversion signal RVS.

Figure 2:
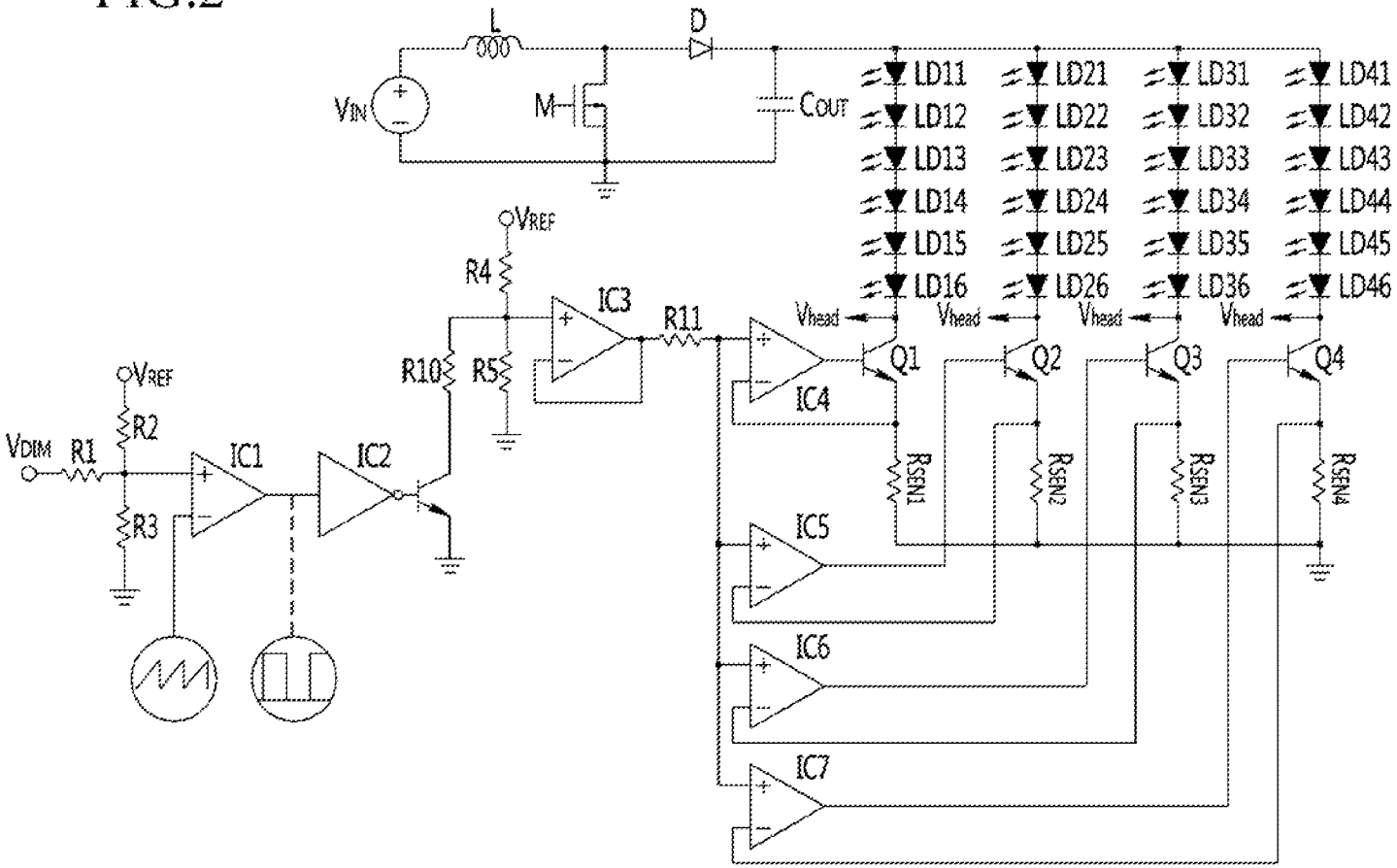
FIG. 2 is a schematic diagram illustrating an LED driver according to an exemplary embodiment of the present invention.

FIG. 2 is a schematic diagram illustrating an LED driver according to an exemplary embodiment of the present invention.

Referring to FIG. 2, a DC/DC converter generates basic power for driving LEDs. The DC/DC converter includes an input voltage source Vin, a coil L, a MOSFET M, a diode D, and a capacitor Cout. According to an embodiment, the DC/DC converter includes at least one of the coil L, the MOSFET M, the diode D, and the capacitor Cout.

LEDs LD11-LD46 are arranged in four LED groups each including six LEDs connected in series. According to embodiments, the number of the LEDs connected in series and the number of the LED groups are variously modified.

A current regulator constantly maintains driving current of the LED. Referring to FIG. 2, the current regulator includes BJTs Q1-Q4 each of which is operated in a linear region.

The BJTs Q1-Q4 each is a transistor having two PN junctions in an NPN type. Each of the BJTs Q1-Q4 includes three terminals of a base, an emitter, and a collector. The base has a P type, and the emitter and the collector each have an N type. The collectors of the BJTs Q1-Q4 are connected to cathodes of the LEDs LD16, LD26, LD36, and LD46, respectively, the bases of the BJTs Q1-Q4 are connected to output terminals of operational amplifiers, respectively, and the emitters of the BJTs Q1-Q4 are connected to sensing resistors Rsen1-Rsen4, respectively.

The BJTs Q1-Q4 have a saturation mode corresponding to a switch-on, a cut-off mode corresponding to a switch-off, and an active mode that performs an amplification operation. The saturation mode is a state in which both an emitter-base junction and a collector-base junction are forward biased, and the cut-off mode is in a state in which both the emitter-base junction and the collector-base junction are reverse biased. The active mode is a state in which the emitter-base junction is forward biased and the collector-base junction is reverse biased. The forward biased state means that voltage applied to a P terminal is higher than voltage applied to an N terminal in the PN junction and the reverse biased state means that the voltage applied to a P terminal is lower than the voltage applied to an N terminal in the PN junction.

The sensing resistors Rsen1-Rsen4 are resistors for feeding back the current for each LED group. First terminals of the sensing resistors Rsen1-Rsen4 are grounded, and second terminals are connected to the emitters of the BJTs Q1-Q4, respectively, and the inversion terminals of the operational amplifiers IC4-IC7, respectively.

The operational amplifiers IC4-IC7 include non-inversion terminals (+), inversion terminals (−), and output terminals. The inversion terminals are connected to the emitters of the BJTs Q1-Q4, and the output terminals are connected to the bases of the BJTs Q1-Q4. The operational amplifiers IC4-IC7 operate BJTs Q1-Q4 based on the sensing resistors Rsen1-Rsen4 and a reference voltage source Vref.

An analog dimming voltage generating unit generates an analog dimming voltage. The analog dimming voltage generating unit includes an operational amplifier IC3 and four resistors R4, R5, R10, and R11. The analog dimming voltage generating unit is connected to a PWM dimming pulse generating unit. The inversion terminal and the output terminal of the operational amplifier IC3 are connected to each other. The operational amplifier IC3 corresponds to a voltage follower which transfers a voltage applied to the non-inversion terminal to the output terminal as is.

The PWM dimming pulse generating unit generates a PWM dimming pulse. The PWM dimming pulse generating unit includes two operational amplifiers IC1 and IC2 and three resistors R1, R2, and R3. The PWM dimming pulse generating unit is connected to the analog dimming voltage generating unit. The operational amplifier IC3 of the analog dimming voltage generating unit is periodically turned on/off by a PWM dimming pulse generated by the operational amplifiers IC1 and IC2 of the PWM dimming pulse generating unit.

The LEDs LD11-LD46 have different power consumption, so that head-room voltages Vhead are different from each other at connection points between the LEDs LD16, LD26, LD36, and LD46 and the BJTs Q1-Q4. For example, driving voltage of an LED is controlled by feeding back a lowest voltage among the head-room voltages Vhead, which is called "head-room control".

When PWM dimming is turned on, if the current flows through the LEDs LD11-LD46, voltages of about 0.8 V to about 1.5 V, which are appropriate for operating the BJTs Q1-Q4 in a linear region, are applied between the collector terminals and the emitter terminals of the BJTs Q1-Q4.

Referring to FIG. 2, when PWM dimming is turned off, the analog dimming voltage is reduced by the resistor R10 connected to the PWM dimming pulse generating unit, the resistor R4 connected to the reference voltage source Vref, and the grounded resistor R5. The magnitude of the analog dimming voltage generated from the analog dimming voltage generating unit is appropriately controlled so that the micro current flows through the LEDs LD11-LD46. For example, the magnitude of the voltage applied between the collector terminal and the emitter terminal of each of the BJTs Q1-Q4 is approximately 2.5 V with respect to one LED, and the current of about 0.1 mA to about 2 mA flows through the LEDs LD11-LD46.

In the related art, when PWM dimming is turned off, an output of the operational amplifier of the analog dimming voltage generating unit is 0 and the BJTs Q1-Q4 are turned off. Accordingly, since all the voltages inputted to the DC/DC converter are applied between the collector terminals and the emitter terminals of the BJTs Q1-Q4, the magnitude of the voltage applied between the collector terminal and the emitter terminal of each of the BJTs is approximately 3.3 V with respect to one LED, and the current flowing through the LEDs is 0 mA.

As a result, even without additional BJTs and wiring, voltage stress of the BJTs Q1-Q4 is decreased by approximately 24% from about 3.3 V to about 2.5 V by controlling the output of the operational amplifier of the analog dimming voltage generating unit. Furthermore, even when the voltage inputted to the entire LEDs is about 100 to about 200 V, rated voltage and power consumption of the BJTs Q1-Q4 used as the current regulator are decreased, such that cost of the BJTs Q1-Q4 is reduced. Since the head room voltage Vhead also decreases, the voltage stress of the LED driver 910 is also reduced.

Figure 3:
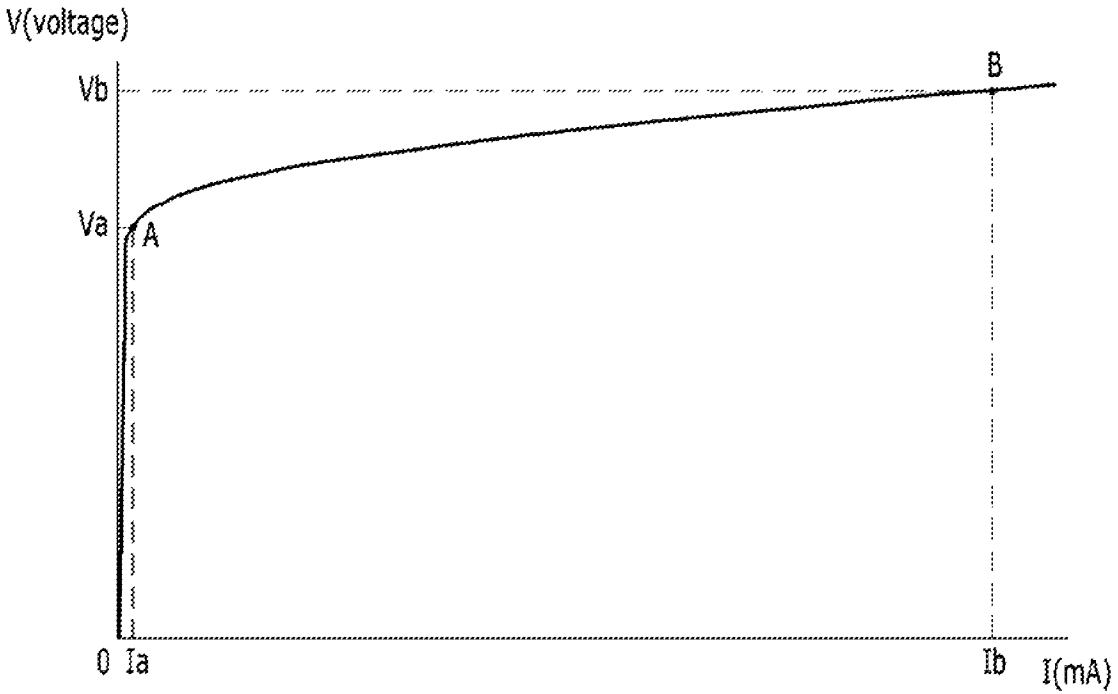
FIG. 3 is a graph illustrating current and voltage characteristics in an LED.

Referring to FIG. 3, an X axis represents a magnitude of the current flowing through an LED in a forward direction, and a Y axis represents a magnitude of the voltage dropping at the LED. For example, Ia is about 2 mA, Va is about 2.5 V, Ib is about 130 mA, and Vb is about 3.3 V. When PWM dimming is turned off and the micro current flows through a CCFL (Cold Cathode Fluorescent Lamp), the characteristic of the CCFL is deteriorated due to the micro current. However, even when PWM dimming is turned off and the micro current flows through the LED, the characteristic of the LED is not deteriorated. Accordingly, if the magnitude of the current flowing through the LED is controlled to be in a range from 0.1 mA to 2 mA approximately corresponding to point A point when PWM dimming is turned off considering the luminance of the backlight, the characteristic of the LED used as the backlight is deteriorated without the voltage stress of the current regulator being reduced.

Figure 4:
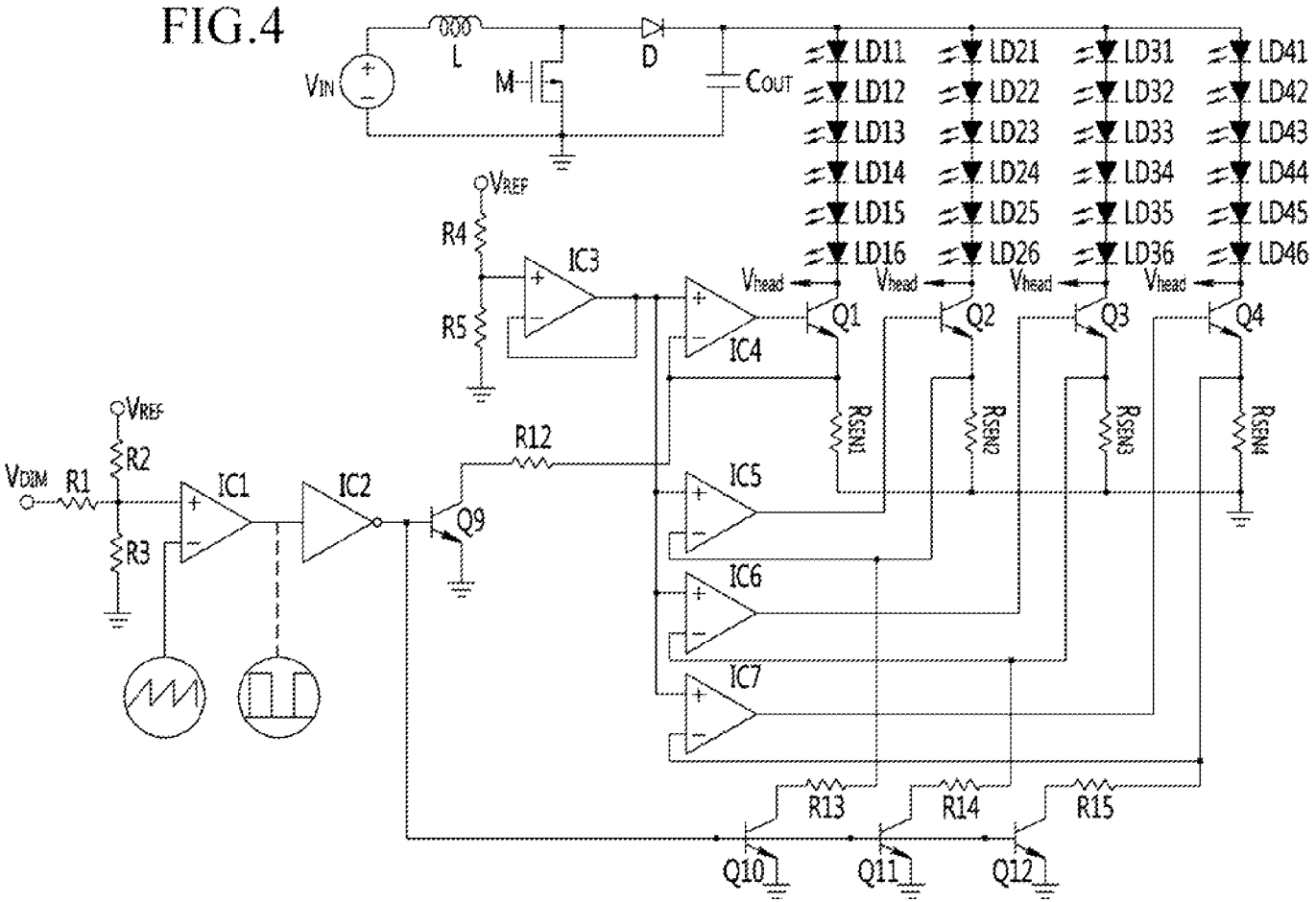
FIG. 4 is a schematic diagram illustrating an LED driver according to an exemplary embodiment of the present invention.

FIG. 2 shows an example of a circuit using a low-current characteristic of the LED by directly controlling the analog dimming voltage and FIG. 4 shows an example of a circuit using a low-current characteristic of the LED by changing a feedback level of the current for each LED group.

Referring to FIG. 4, additional BJTs Q9-Q12 may increase the feedback level of current when PWM dimming is turned off, thus allowing the micro current to flow through the LED. According to an embodiment, the additional BJTs Q9-Q12 are built in the LED driver 910, which further reduces costs compared to where the BJTs Q9-Q12 are provided outside the LED driver 910.

Referring to FIG. 4, a DC/DC converter generates basic power for driving LEDs. The DC/DC converter includes an input voltage source Vin, a coil L, a MOSFET M, a diode D, and a capacitor Cout. According to an embodiment, the DC/DC converter includes at least one of the coil L, the MOSFET M, the diode D, and the capacitor Cout.

LEDs LD11-LD46 are arranged in four LED groups each including six LEDs connected in series. According to embodiments, the number of the LEDs connected in series and the number of the LED groups are variously modified.

A current regulator includes BJTs Q1-Q4 that are operated in a linear region.

The BJTs Q1-Q4 each is a transistor having two PN junctions in an NPN type. Each of the BJTs Q1-Q4 includes three terminals of a base, an emitter, and a collector. The base has a P type, and the emitter and the collector each have an N type. The collectors of the BJTs Q1-Q4 are connected to cathodes of the LEDs LD16, LD26, LD36, and LD46, respectively, the bases of the BJTs Q1-Q4 are connected to output terminals of operational amplifiers, respectively, and the emitters of the BJTs Q1-Q4 are connected to sensing resistors Rsen1-Rsen4, respectively.

The BJTs Q1-Q4 have a saturation mode corresponding to a switch-on, a cut-off mode corresponding to a switch-off, and an active mode that performs an amplification operation.

The sensing resistors Rsen1-Rsen4 are resistors for feeding back the current for each LED group. First terminals of the sensing resistors Rsen1-Rsen4 are grounded, and second terminals are connected to the emitters of the BJTs Q1-Q4, respectively, the inversion terminals of the operational amplifiers IC4-IC7, respectively, and resistors R12-R15, respectively.

The operational amplifiers IC4-IC7 include non-inversion terminals (+), inversion terminals (−), and output terminals. The inversion terminals are connected to the emitters of the BJTs Q1-Q4, respectively, and the resistors R12-R15, respectively, and the output terminals are connected to the bases of the BJTs Q1-Q4, respectively. The operational amplifiers IC4-IC7 operate BJTs Q1-Q4 based on the sensing resistors Rsen1-Rsen4 and a reference voltage source Vref.

An analog dimming voltage generating unit generates an analog dimming voltage. The analog dimming voltage generating unit includes an operational amplifier IC3 and two resistors R4 and R5. The inversion terminal and the output terminal of the operational amplifier IC3 are connected to each other. The operational amplifier IC3 corresponds to a voltage follower which transfers a voltage applied to the non-inversion terminal to the output terminal as is.

The PWM dimming pulse generating unit generates a PWM dimming pulse. The PWM dimming pulse generating unit includes two operational amplifiers IC1 and IC2 and three resistors R1, R2, and R3. The PWM dimming pulse generating unit is connected to the inversion terminals of the operational amplifiers IC4-IC7 through the BJTs Q9-Q10 and the resistors R12-R15.

The LEDs LD11-LD46 have different power consumption, so that head-room voltages Vhead are different from each other at connection points between the LED LD16, LD26, LD36, and LD46 and the BJTs Q1-Q4. For example, driving voltage of an LED is controlled by feeding back a lowest voltage among the head-room voltages Vhead.

Referring to FIG. 4, when PWM dimming is turned off, the micro current flows through the LED due to an increase in the feedback level of the current by the BJTs Q9-Q12. For example, the magnitude of the voltage applied between the collector terminal and the emitter terminal of BJTs Q1-Q4 is approximately 2.5 V with respect to one LED, and the current of about 0.1 mA to about 2 mA flows through the LEDs LD11-LD46.

As a result, even without additional wiring, voltage stress of the BJTs Q1-Q4 is decreased by approximately 24% from about 3.3 V to about 2.5 V by increasing the feedback level of the current. Furthermore, even when the voltage inputted to the entire LEDs is approximately 100 to 200 V, rated voltage and power consumption of the BJTs Q1-Q4 used as the current regulator are decreased, such that cost of the BJTs Q1-Q4 is reduced. Since the head-room voltage Vhead also decreases, the voltage stress of the LED driver 910 is also reduced.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A light emitting diode (LED) driver, comprising:

a light emitting diode;

a converter connected to the light emitting diode, wherein the converter receives an input voltage and converts the input voltage to a voltage for driving the light emitting diode;

a current regulator connected to the light emitting diode;

a first operational amplifier connected to the current regulator;

an analog dimming voltage generating unit connected to the first operational amplifier, the analog dimming voltage generating unit comprising a second operational amplifier, a first resistor, a second resistor, and a third resistor, wherein a first terminal of the first resistor, a first terminal of the second resistor, and a first terminal of the third resistor are connected to a non-inversion terminal of the second operational amplifier; and a pulse-width-modulation dimming pulse generating unit connected to a second terminal of the third resistor.

2. The light emitting diode (LED) driver of claim 1, wherein a second terminal of the first resistor is connected to a reference voltage and a second terminal of the second resistor is grounded.

3. The light emitting diode (LED) driver of claim 2, wherein an inversion terminal of the second operational amplifier is connected to an output terminal of the second operational amplifier.

4. The light emitting diode (LED) driver of claim 3, wherein the output terminal of the second operational amplifier is connected to a non-inversion terminal of the first operational amplifier.

5. The light emitting diode (LED) driver of claim 1, wherein a fourth resistor is connected between the output terminal of the second operational amplifier and the non-inversion terminal of the first operational amplifier.

6. The light emitting diode (LED) driver of claim 1, wherein the current regulator comprises a bipolar junction transistor.

7. The light emitting diode (LED) driver of claim 6, wherein a base of the bipolar junction transistor is connected to an output terminal of the first operational amplifier, an emitter of the bipolar junction transistor is connected to the inversion terminal of the first operational amplifier, and a collector of the bipolar junction transistor is connected to the light emitting diode.

8. The light emitting diode (LED) driver of claim 1, further comprising:

a sensing resistor connected to the current regulator.

9. The light emitting diode (LED) driver of claim 8, wherein a first terminal of the sensing resistor is connected to the inversion terminal of the first operational amplifier and the current regulator, and a second terminal of the sensing resistor is grounded.

10. A light emitting diode (LED) driver, comprising:

a light emitting diode;

a converter connected to the light emitting diode, wherein the converter receives an input voltage and converts the input voltage to a voltage for driving the light emitting diode;

a light emitting diode connected to the converter;

a first current regulator connected to the light emitting diode;

a first operational amplifier connected to the first current regulator;

a second current regulator connected to the first current regulator and the first operational amplifier;

an analog dimming voltage generating unit connected to the first operational amplifier, the analog dimming voltage generating unit comprising a second operational amplifier, a first resistor, and a second resistor, wherein a first terminal of the first resistor and a first terminal of the second resistor are connected to a non-inversion terminal of the second operational amplifier; and a pulse-width-modulation dimming pulse generating unit connected to the second current regulator.

11. The light emitting diode (LED) driver of claim 10, wherein the first current regulator comprises a first bipolar junction transistor, and a second current regulator comprises a second bipolar junction transistor.

12. The light emitting diode (LED) driver of claim 11, wherein an emitter of the first bipolar junction transistor and a collector of the second bipolar junction transistor are connected to an inversion terminal of the first operational amplifier.

13. The light emitting diode (LED) driver of claim 12, wherein a base of the second bipolar junction transistor is connected to the pulse width modulation dimming pulse generating unit, and an emitter of the second bipolar junction transistor is grounded.

14. The light emitting diode (LED) driver of claim 11, wherein a third resistor is connected between a collector of the second bipolar junction transistor and an inversion terminal of the first operational amplifier.

15. The light emitting diode (LED) driver of claim 10, further comprising:

a sensing resistor connected to the first current regulator and the second current regulator.

16. The light emitting diode (LED) driver of claim 15, wherein a first terminal of the sensing resistor is connected to an inversion terminal of the first operational amplifier, the first current regulator, and the second current regulator, and a second terminal of the sensing resistor is grounded.

17. The light emitting diode (LED) driver of claim 10, wherein a second terminal of the first resistor is connected to a reference voltage, and a second terminal of the second resistor is grounded.

18. The light emitting diode (LED) driver of claim 17, wherein an inversion terminal of the second operational amplifier is connected to an output terminal of the second operational amplifier.

19. The light emitting diode (LED) driver of claim 18, wherein the output terminal of the second operational amplifier is connected to a non-inversion terminal of the first operational amplifier.

20. A light source driver for a light source, comprising:

a voltage converter connected to the light source;

a current regulator connected to the light source;

an operational amplifier connected to the current regulator;

an analog dimming voltage generating unit including a first terminal, a second terminal, and a third terminal, wherein the first terminal is connected to a reference voltage, and the second terminal is connected to a non-inversion terminal of the operation amplifier; and a pulse-width-modulation (PWM) dimming pulse generating unit connected to the third terminal of the analog dimming voltage generating unit, wherein the analog dimming voltage generating unit adjusts an analog dimming voltage so that a micro current flows through the light source when a PWM dimming pulse is turned off by the PWM dimming pulse generating unit.

* * * * *